United States Patent [19]

Gregory

[11] Patent Number: 4,563,965

[45] Date of Patent: Jan. 14, 1986

[54] ACOUSTICAL SHIELD ASSEMBLY AND MATING THREAD PREGUIDE UNIT

[75] Inventor: Lee W. Gregory, Hickory, N.C.

[73] Assignee: Marvel Specialty Company, Hickory, N.C.

[21] Appl. No.: 636,834

[22] Filed: Aug. 2, 1984

[51] Int. Cl.[4] ..... D05B 47/00; D05B 77/00

[52] U.S. Cl. ..... 112/302; 112/258; 112/261; 181/205; 242/18 R; 242/157 R

[58] Field of Search ..... 112/302, 258, 261; 242/157 R, 18 R, 35.5 R; 181/200, 201, 205, 202, 203, 204; 139/1 R; 28/212; 57/358

[56] References Cited

U.S. PATENT DOCUMENTS

| | | | |
|---|---|---|---|
| 1,956,338 | 4/1934 | Bartling | 242/157 R |
| 2,417,706 | 3/1947 | Scarborough | 242/157 R |
| 3,067,704 | 12/1962 | Pedersen . | |
| 3,638,594 | 2/1972 | Armstead, Jr. et al. . | |
| 3,741,618 | 6/1973 | Newman | 112/258 X |
| 3,773,140 | 11/1973 | Mahajan et al. . | |
| 3,782,087 | 1/1974 | Franzen et al. | 181/205 X |
| 3,822,763 | 7/1974 | Adams et al. | 181/204 |
| 3,930,558 | 1/1976 | Schnell et al. | 181/200 |
| 4,074,725 | 2/1978 | Bader et al. . | |
| 4,093,066 | 6/1978 | Mitchell et al. | 181/200 X |
| 4,110,876 | 9/1978 | Weiss et al. | 181/200 X |
| 4,215,762 | 8/1980 | Cunningham et al. | 181/201 |
| 4,347,989 | 9/1982 | Pieper et al. | 242/35.5 R |
| 4,456,092 | 6/1984 | Kubozuka et al. | 181/204 X |

*Primary Examiner*—Werner H. Schroeder
*Assistant Examiner*—Andrew M. Falik
*Attorney, Agent, or Firm*—King, Liles & Schickli

[57] ABSTRACT

An acoustical shield assembly and mating thread preguide unit include a series of acoustically insulated panels that substantially surround a sewing machine so as to be operative in attenuating any generated noise. A portion of the top panel, including a downwardly extending flange, is hinged to move between an opened position allowing access to the sewing machine and a closed position for mating with the preguide unit. The preguide unit is mounted to the sewing machine by a pair of adjustable mounting rods and includes two face plates spaced apart by means of a pair of spacer posts. Each face plate includes eyelets between the spacer posts for the passage of thread to the sewing machine. When the hinged portion of the top panel is closed, an elongated opening is formed between the downwardly extending flange and the top edge of the adjacent rear side panel of the shield assembly. The preguide unit is received in the opening with bearing surfaces of the spacer posts engaging both the downwardly extending flange and top edge of the rear side panel. The spacer posts serve to seal the ends of the elongated opening. Additionally, the exterior surface of the inner face plate seals against the interior surfaces of the downwardly extending flange and rear side panel adjacent the opening to provide maximum sound attenuation.

15 Claims, 6 Drawing Figures

ACOUSTICAL SHIELD ASSEMBLY AND MATING THREAD PREGUIDE UNIT

TECHNICAL FIELD

The present invention relates to noise attenuation in industrial sewing machines and more particularly concerns an acoustical shield assembly with a mating thread preguide for protecting workers from noise generated by the operation of a sewing machine.

BACKGROUND OF THE INVENTION

In recent years, considerable effort has been directed toward the protection of workers from the high noise levels generated by industrial machines. When high speed machinery, such as sewing machines, is involved, noise reduction activities have been focused in two major areas. The first area of activity is in the redesign and engineering of the machines themselves to eliminate the noise at its source. However, the inherent nature of high speed sewing machines and the economics of redesign place limitations upon the practical potential of sufficiently reducing sewing machine noise levels. Furthermore, many existing machines have undesirably high operating noise levels. Modification of these existing machines for reducing the noise to an acceptable level is highly impractical, and in many cases, impossible. Hence, considerable activity has been focused upon the development of noise attenuation structures for acoustically shielding and insulating the noise from a worker an example of such a structure is disclosed in Applicant's U.S. Pat. No. 4,509,442.

The design of acoustical shields for insulating workers from noise generated by industrial sewing machines has been complicated by several factors. One of the complicating factors is the need for access to the working components of the machine. In this regard, access to the thread track is of particular importance. Such access is needed not only for maintenance and repair, but also for routine operational procedures. Unfortunately, acoustical shields inherently tend to interfere with the required access to the sewing machine. For example, many prior art designs require cumbersome disassembly and reassembly of the acoustical shield to gain access to the machine.

A further complicating factor in acoustical shield design for sewing machines is the need to freely feed thread to the sewing machine from a source outside the acoustical shield. Prior acoustical shield designs for sewing machines or the like have tended to either interfere with the thread feed from an external source or have left substantial voids in the acoustical shield itself, which voids have substantially and adversely effected the efficiency of the acoustical shield assembly. In U.S. Pat. No. 4,074,725 to Bader et al, for example, a multicomponent hinged cover for attenuating noise generated by selective components of a weaving machine is disclosed. However, the noise attenuating cover disclosed in this mentioned patent does not even attempt to attenuate noise escaping from the machine about the thread intake.

SUMMARY OF THE INVENTION

It is, therefore, a primary object of the invention to provide an acoustical shield assembly for an industrial sewing machine which overcomes the above mentioned deficiencies in the prior art.

Another object of the invention is to provide an acoustical shield assembly for an industrial sewing machine wherein the machine generated noise is reduced to an acceptable level without compromising the necessary machine access required for high operational efficiency.

A further object of the invention is to provide an acoustical shield assembly for a sewing machine providing ready access to the machine for maintenance purposes.

Yet another object of the invention is to provide an acoustical shield assembly for a sewing machine wherein the assembly may be removed from the sewing machine without the necessity of removing thread.

A still further object of the invention is to provide a sewing machine with an acoustical shield assembly wherein thread may be freely fed to an enclosed sewing machine from an external source along a thread path substantially sealed against acoustical noise.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved acoustical shield assembly and thread preguide unit is provided for attenuating noise generated by a sewing machine or the like. The acoustical shield assembly includes a series of panels closely spaced from and substantially surrounding the sewing machine so as to be operative in attenuating noise generated by the sewing machine. A thread preguide unit adapted for mounting to the sewing machine cooperates with the acoustical assembly to direct thread to the sewing machine. Means are also provided for mating said preguide unit with the acoustical shield assembly to maximize noise attenuation.

In accordance with a further aspect of the invention, the thread preguide unit includes first and second face plates.

According to another aspect of the invention, each of the face plates of the thread preguide unit includes at least one eyelet for receiving thread directed to the sewing machine.

In another aspect of the invention, means are provided for spacing the face plates of the thread preguide unit from each other.

In a preferred form of the invention, the spacing means includes two spacer posts extending between and connecting the first and second face plates.

According to another aspect of the invention, the position of the thread preguide unit is adjustable relative to the sewing machine and acoustical shield assembly so as to provide proper mating of the preguide unit with the acoustical shield assembly for maximum noise attenuation.

In one specific aspect of the invention, the thread preguide unit is mounted to the sewing machine by first and second mounting rods.

In yet another aspect of the invention, there are elongated apertures provided in the second face plate for adjusting the relative position between the thread preguide unit with the sewing machine and acoustical assembly. Preferably, the mounting rods are slidably received in the elongated aperture for this purpose.

In another aspect of the invention, altering the relative position between the thread preguide unit and the sewing machine and acoustical assembly is achieved by a slot means in the mounting rods allowing positioning of the face plates of the preguide unit toward and away from the sewing machine for proper mating with the shield assembly.

In a further feature of the invention, the acoustical shield assembly includes a top panel having a hinged portion including a downwardly extending flange movable between an open position allowing access to the sewing machine and a closed position for mating with the preguide unit.

According to another specific aspect of the invention, the downwardly extending flange, when in the closed position, cooperates with an underlying side panel to define an elongated opening for receipt of the preguide unit.

In another aspect of the invention, the thread preguide unit and acoustical assembly are mated by upper and lower bearing surfaces on each of the spacer posts. The upper bearing surfaces contact the downwardly extending flange of the hinged top panel and the lower bearing surfaces contact the underlying side panel.

In another aspect of the invention, at least one eyelet is positioned between and in the same plane as the spacer posts on the face plates, and the thread passes through the elongated openings between the spacer posts with the spacer posts sealing the ends of the elongated opening for maximum noise attenuation.

In yet another aspect of the invention, the means for mating the acoustical assembly and thread preguide unit includes opposing first and second sealing surfaces. The first sealing surface is provided along the interior of the downwardly extending flange and the underlying panel adjacent the elongated opening. The second surface is provided along the surface of the second face plate facing the first face plate. The first and second sealing surfaces contact each other when the preguide unit is properly positioned in relation to the shield assembly so as to seal the assembly for maximum noise attenuation.

In yet another aspect of the invention, the acoustical shield assembly includes a further side panel substantially perpendicular to the rear side panel and positioned adjacent to the preguide assembly. The end side panel is readily displaceable from the remainder of the acoustical shield assembly, thereby allowing removal of the shield assembly from around the sewing machine and attached preguide unit when the hinged top portion is open. In this way, access to the machine is allowed for maintenance purposes without the need to remove the thread from the sewing machine.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
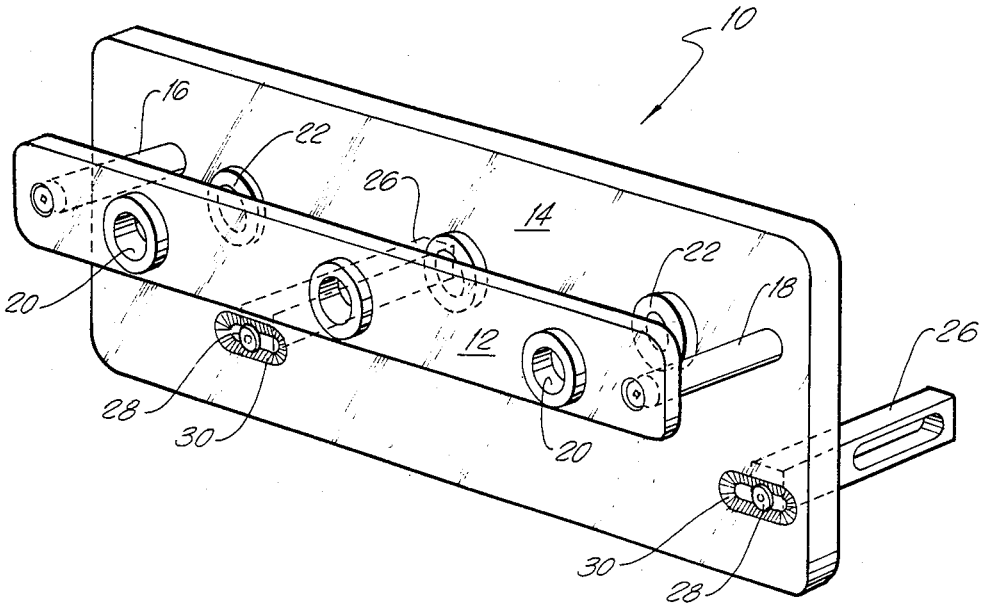
FIG. 1 is a perspective view of a multipanel thread preguide unit for directing a series of threads through a closed and sealed opening of an acoustical shield assembly for a sewing machine in accordance with the principles of the present invention.

Referring now to the drawings, FIG. 1 depicts a multiplate thread preguide unit 10 constructed in accordance with the principles of the present invention. The illustrated thread preguide unit 10 includes first and second elongated face plates 12 and 14. In the particular thread guide unit illustrated, the second face plate 14 is approximately three times the height of the first face plate 12, with both face plates 12, 14 having substantially equal lengths.

The face plates 12,14 are rigidly maintained in spaced parallel relationship with each other by a spacing means, specifically shown as a pair of spacer posts 16 and 18 in the preferred embodiment. A first series of spaced eyelets 20 extend through the first face plate 12. This first series of eyelets 20 is aligned with a second series of eyelets 22 extending through the second face plate 14. As will become more fully apparent from the description that follows, the two aligned series of eyelets 20,22 define a thread inlet through an acoustical shield assembly for a series of threads being fed to a sewing machine 24 (see FIG. 3).

The illustrated thread preguide unit 10 further includes a pair of mounting rods 26 secured to the face plate 14. As suggested by the depiction of in FIG. 1, it is preferable to adjustably secure the mounting rods 26 to the face plate 14. In the specifically illustrated embodiment, this adjustable securement is achieved by extending screws 28 through elongated apertures 30 in the face plate 14 and into the axial ends of the mounting rods 26. It will be noted that the apertures 30 are elongated in the lateral direction of the face plate 14. Those skilled in the art will readily appreciate that such elongation provides lateral adjustment between the face plate 14 and the mounting rods 26.

Figure 2:
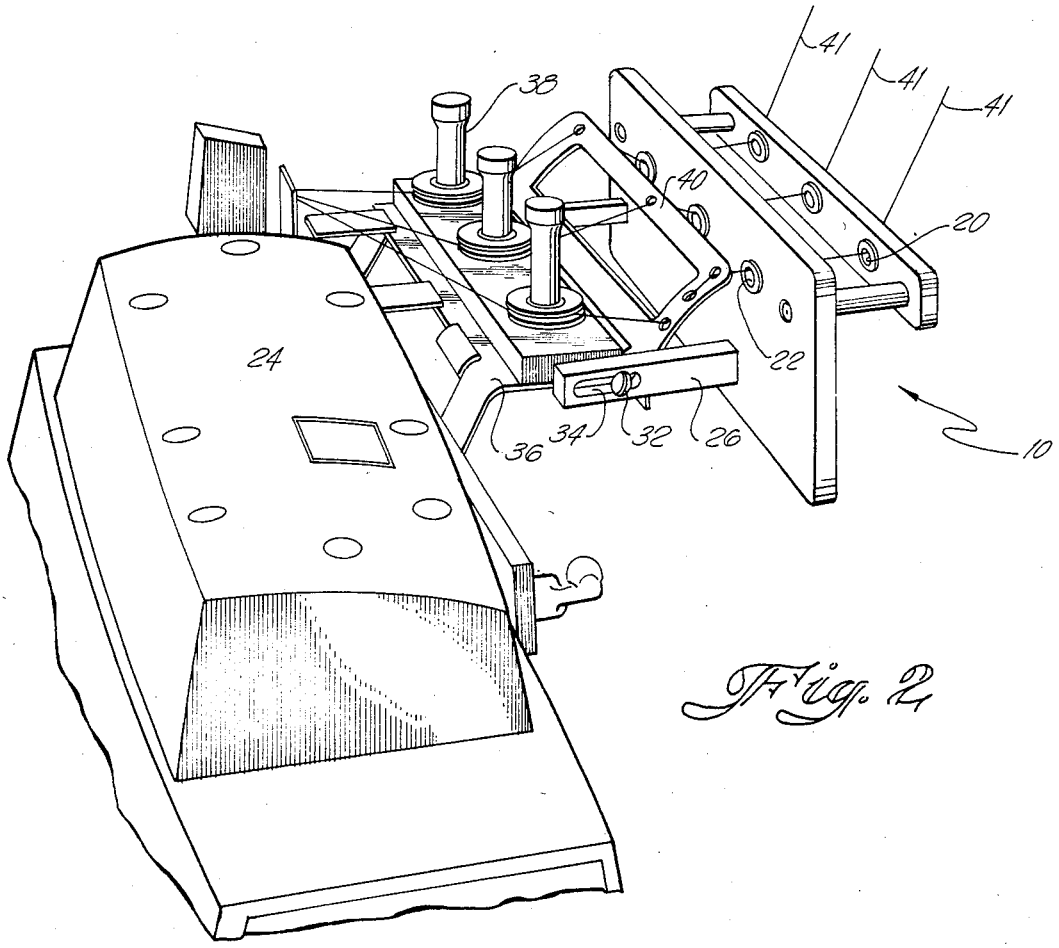
FIG. 2 is a perspective view of the thread preguide unit of FIG. 1 showing the unit properly attached to a sewing machine.

Turning now to FIG. 2, it may be seen that the mounting rods 26 are used to adjustably mount the thread preguide unit 10 to a sewing machine 24. Fasteners 32, such as screws, pass through elongated slots 34 formed in the mounting rods 26 and extend into a mounting bracket 36, which mounting bracket 36 is fixedly secured to the sewing machine 24. The elongated slots 34 provide a further means for adjusting the position of the thread preguide unit 10 relative to the sewing machine 24. The mounting bracket 36 further supports a plurality of thread tensioning guides 38 and a thread alignment guide 40. As also seen in FIG. 2, a series of threads 41 for the sewing machine 24 are directed from an external source (not shown) through the aligned series of eyelets 20 and 22 of face plates 12 and 14 respectively. The threads 41 are then directed through the thread alignment guide 40, and thread tensioning guides 38 to the thread path for the sewing machine 24. The particular machine 24 shown is a Union Special; however, other machines are similar and adapted to use the principles of the invention equally as well.

Figure 3:
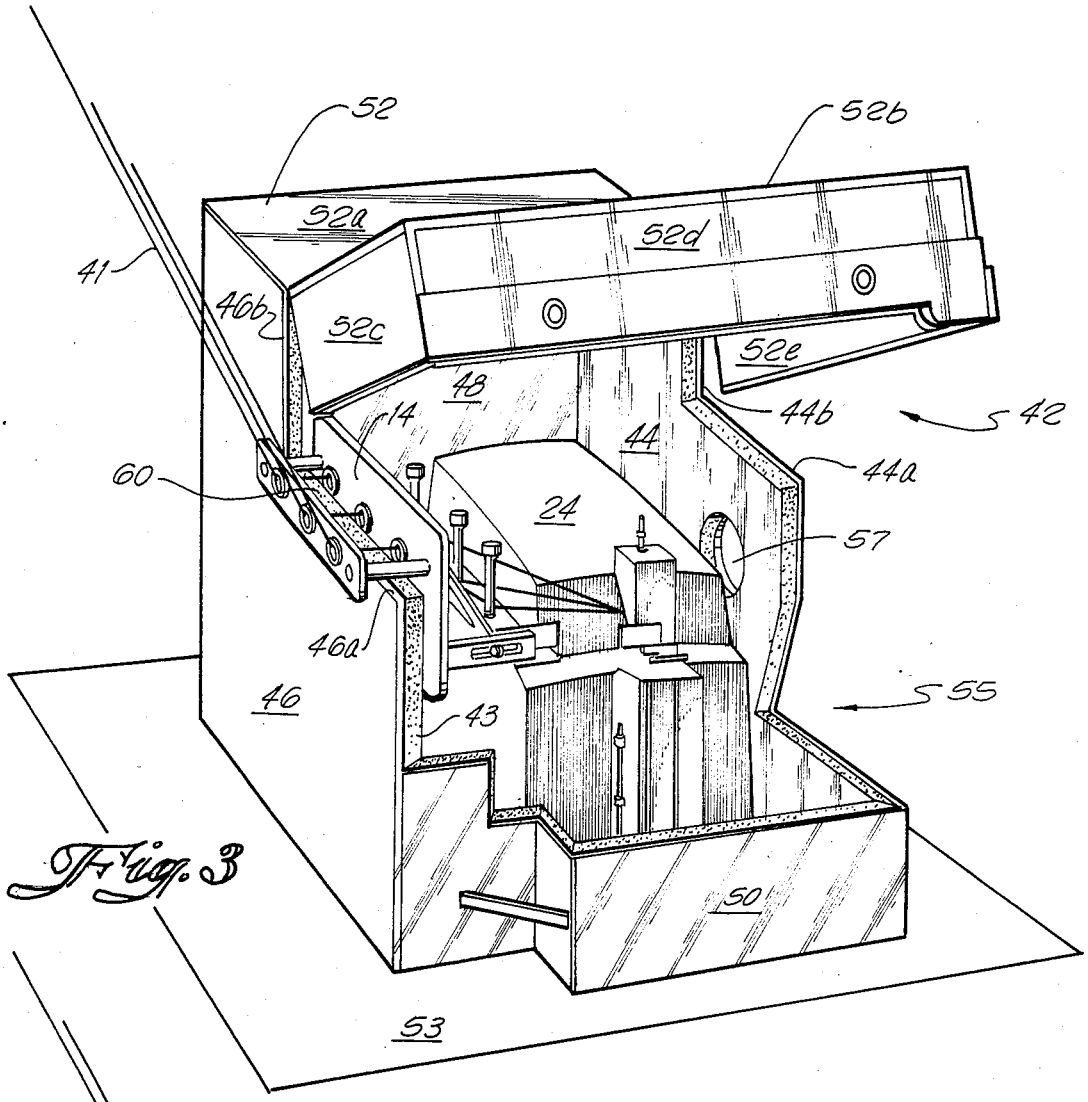
FIG. 3 is a perspective view of the sewing machine and thread preguide unit of FIG. 2 enclosed within an acoustical shield assembly in accordance with the invention.

In order to protect workers from the high levels of noise generated by the sewing machine 24 during operation, the machine 24 is substantially enclosed within an acoustical shield assembly 42, most fully depicted in FIG. 3. Preferably, the acoustical shield assembly 42 is a multipanel structure substantially surrounding the entire sewing machine 24 for maximum noise attenuation. In the preferred construction, the acoustical shield assembly 42 includes front and rear panels 44 and 46 respectively. These front and rear panels cooperate with oppositely disposed side panels 48 and 50, a top panel 52, and a base 53 supporting the sewing machine 24. The panels 44 and 46 each have a rectangular cutout section in the top portion of the respective panels adjacent to the side panel 50. The cutout portion of front panel 44 is defined by edges **44*a* and 44*b*, while the cutout portion of rear panel 46 has edges 46*a* and 46*b*. The side panel 48 extends the entire height of the acoustical shield assembly 42 and mates against the top panel 52. However, for reasons which will be explained hereinafter, the top edge of the side panel 50 terminates far short of the top panel 52, leaving a substantial opening 55 in the shield assembly 42 above the side panel 50**.

The fabricated acoustical shield assembly 42 is lined with an energy absorbing foam 43 for the purpose of absorbing and dampening noise generated within the assembly 42. The foam 43 is also highly elastic and operative to close acoustical cracks, such as may occur between adjacent panel members.

Figure 3A:
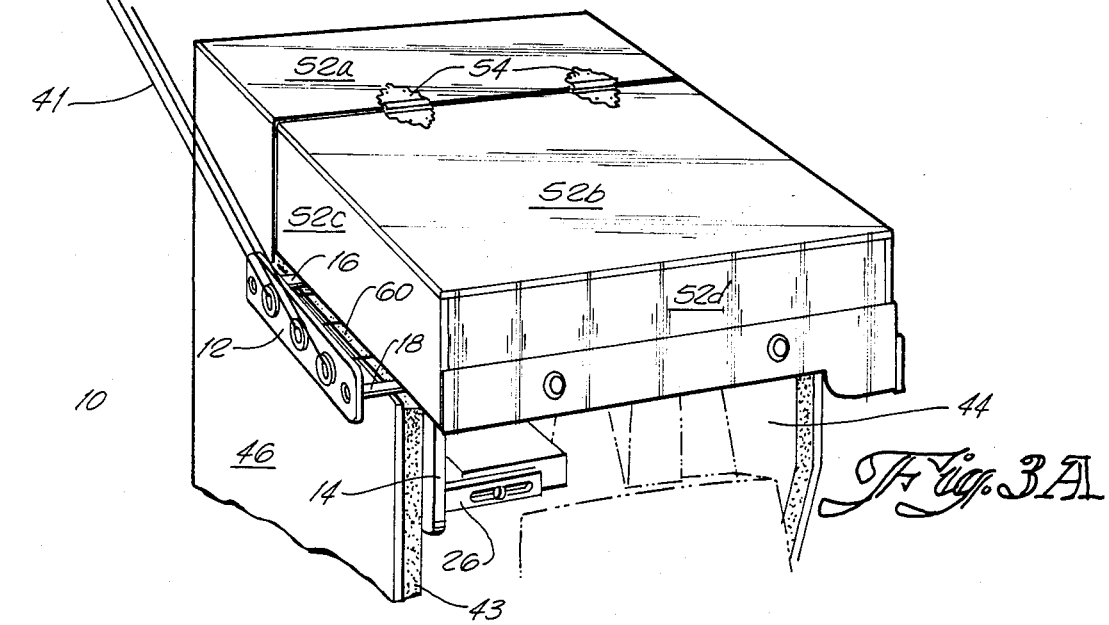
FIG. 3A is a perspective view similar to FIG. 3, but showing the top panel of the acoustical shield moved to a closed position in mating relationship to the thread preguide unit.

In carrying out the invention, the top panel 52 includes fixed and hinged portions **52*a* and 52*b* respectively, hinged portion 52*b* being secured to fixed portion 52*a* by a pair of hinges 54, as shown in FIG. 3A. The top panel 52 further includes three downwardly extending flanges 52*c*, 52*d*, and 52*e*. The downwardly extending flange 52*c* is in the same plane as rear panel 46 and downwardly extending flange 52*e* is in the same plane as front panel 44. When the hinged portion 52*b* is moved to the closed position, as shown in FIG. 3A, the downwardly extending flange 52*e* seats against the front panel cutout edges 44*a* and 44*b*, closing the cutout portion of the front panel 44. In a similar manner, downwardly extending flange 52*c* seats against vertical cutout edge 46*b* in rear panel 46. However, the flange 52*c* does not completely extend to the rear panel edge 46*a*. An elongated opening 60**, as best shown in FIG. 3A results.

Focusing now on FIG. 3A, the elongated opening 60 is shown as being dimensioned to mate with the thread preguide unit 10. More particularly, the elongated opening 60 is matched with the dimensions of the thread preguide unit 10, and as described in detail below, the thread preguide unit 10 is adjusted into sealing relationship with the shield assembly 42. The spacer posts 16,18 of the illustrated embodiment extend through the elongated opening 60 when the hinged portion **52*b* of top panel 52 is moved to the closed position. In this closed position of the top panel, the face plate 14 is disposed on the inside of the acoustical shield assembly 42, with the face plate 12 being disposed on the outside. The height of the resulting elongated opening 60 approximates the diameter of the spacer posts 16 and 18. Thus, the top sections of the spacers posts 16,18 serve as bearing surfaces for the hinged portion 52*b* of the top panel 52, and the bottom sections of the spacer posts 16,18 serve as bearing surfaces contacting the underlying rear panel 46**.

Figure 4:
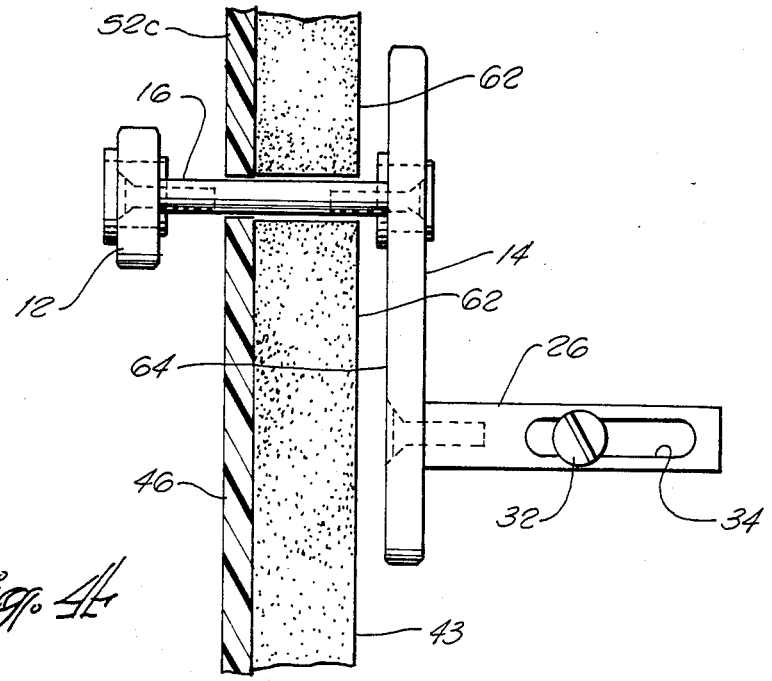
FIG. 4 is a fragmentary view, partially in cross-section, of the thread preguide unit extending through an elongated opening in the acoustical shield assembly.
Figure 4A:
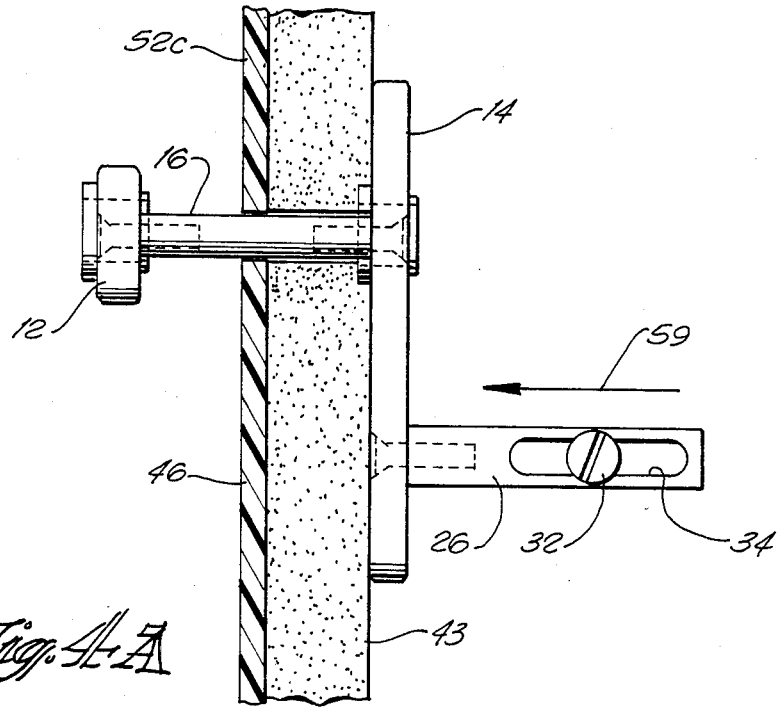
FIG. 4A is a fragmentary view, similar to FIG. 4, but showing the thread preguide unit adjusted in proper mating relationship with the acoustical shield assembly to sealingly close the elongated opening.

Turning now to FIG. 4, the relationship between the downwardly extending flange **52*c*, support posts 16,18 and the rear panel 46 is shown in greater detail. It will be appreciated that the support posts 16,18 only partially fill the elongated opening 60. Thus, with the thread preguide unit positioned as depicted in FIG. 4, the portion of opening 56 between the spacer posts 16,18 is occupied by only the threads 41. FIG. 4A shows the thread preguide unit 10 after it has been moved from the FIG. 4 position into proper mating with the acoustical assembly 42, as indicated by arrow 59. In the FIG. 4A position, a first sealing surface 62 (see FIG. 4) on the interior of the acoustical shield assembly 42 sealingly contacts a second sealing surface 64 (FIG. 4) on the surface of the face plate 14, the sealing surface 64 on plate 14 being that surface facing the face plate 12. The first sealing surface 62 includes both the interior of the downwardly extending flange 52*c* and the underlying rear side panel 46. Proper mating between the thread preguide unit 10 and the acoustical shield assembly 42 is achieved by adjusting the position of the preguide unit 10 relative to the sewing machine 24 and the acoustical assembly 42. In the illustrated embodiment, this adjustment is effectuated by relatively moving the screws 32 within the elongated slots 34 in the mounting rods 26**.

In accordance with a further aspect of the invention, the series of eyelets 20 and 22 extending through face plates 12 and 14 respectively are aligned in the same plane with and disposed between the support posts 16 and 18. Hence, when the thread preguide unit 10 is moved to the FIG. 4A position, the threads 41 pass between the flange **52*c* and rear panel 46 in the space between the support posts 16,18. This permits unencumbered movement of the threads 41 while substantially closing the elongated opening 60. Further, with the spacer posts 16 and 18 positioned at opposite longitudinal ends of the series of eyelets 20,22, the spacer posts 16,18 serve to seal the ends of the elongated opening 60. With the opening 60 so sealed, the only opening for the passage of noise from the rear of the sewing machine 24 is through the relatively small openings of the eyelets 20,22**.

Returning to FIG. 3A, it is seen that the multipanel acoustical shield assembly 42 substantially surrounds the sewing machine 24 during operation. The only substantial acoustical opening to the sewing machine 24 is the opening 55 remaining above the side panel 50, an opening which is necessary for accessing the sewing machine during routine operation. The opening 55 also provides for dissipation of machine generated heat. A small oil window 57 (FIG. 3) is also provided in the front panel 44 for routinely lubricating the sewing machine without the necessity of removing the acoustical shield 42.

In order to protect workers from noise escaping from the opening 55, an independently supported and rotatably removable face shield formed of a transparent material, such as Plexiglas brand glass sheeting, is positioned between the worker and the opening 51. The transparency of the face shield permits the machine operator to monitor the position of his hands and/or fabric in the area about the sewing machine 24. Illustration of this face shield has been omitted in the interest of clarity of illustration, since the face shield forms no part, per se, in the present invention.

The multiple panels of the acoustical shield assembly 42 may, in general, be formed either integrally or separately. If formed separately, the absorbing foam liner 43 functions to close acoustical cracks between the panel members. In a preferred form of the invention, the side panel 50 is formed separately and is readily displaceable from the remainder of the acoustical shield assembly. In this way, the entire acoustical shield assembly may be removed from the sewing machine 20 for maintenance purposes without the need to remove the threads 41 from the sewing machine. In the illustrated form of he invention, side shield 50 is structurally independent of the front and rear shields 44,46 and is merely rested on the base 53 in cooperative relationship to the front and rear panels 44,46.

In summary, numerous benefits have been described which result from employing the concepts of the invention. The combined acoustical shield assembly and thread preguide unit substantially dissipate the noise generated by an industrial sewing machine without compromising access to the machine required for high operational efficiency, maintenance or repair. The closely mated relationship between the acoustical shield assembly and the thread preguide unit significantly reduces noise escaping from the acoustical assembly. In the preferred form of the invention, the sealingly mated relationship between one of the face plates with the acoustical shield assembly blocks the escape of sound about the thread infeed. Additionally, with the eyelets positioned between and in the same plane as the spacer posts, the spacer posts cooperate with the panel through which the thread is fed and a downwardly extending flange of a top panel to further acoustically seal the thread infeed. The thread preguide unit is preferably adjustably movable with respect to the acoustical shield assembly and sewing machine to facilitate proper mating to maximize noise dissipation. Such adjustability is provided in the illustrated structure by adjustably securing the face plates to the mounting rods and by adjustably securing the mounting rods to the sewing machine. Construction of the side panels of the acoustical shield to be readily displaceable from the remainder of the acoustical shield assembly provides for complete removal of the acoustical shield assembly for maintenance or repair purposes without the need to remove the thread from the sewing machine.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. An acoustical shield assembly and thread preguide unit adapted for attenuating noise generated by a sewing machine of the like, said acoustical shield assembly including a series of panels closely spaced from and substantially surrounding and conforming to the sewing machine so as to be operative in attenuating noise generated by the sewing machine, said acoustical shield assembly further including an opening for easy access to the sewing machine during routine operation;

means for mounting said preguide unit to the sewing machine; and means for mating said preguide unit in substantially sealing relation with said acoustical shield assembly for maximum noise attenuation.

2. The acoustical shield assembly and thread preguide unit of claim 1, wherein said preguide unit includes first and second face plates.

3. The acoustical shield assembly and thread preguide unit of claim 2, wherein each face plate includes at least one eyelet for receiving the thread.

4. The acoustical shield assembly and thread preguide unit of claim 2, wherein means are provided for spacing said face plates from each other.

5. The acoustical shield assembly and thread preguide unit of claim 4, wherein said spacing means include a plurality of spacer posts extending between and connecting said first and second face plates.

6. The acoustical shield assembly and thread preguide uit of claim 5, wherein said acoustical shield assembly includes a top panel having a hinged portion including a downwardly extending flange movable between an open position allowing access to the sewing machine and a closed position for mating with said preguide unit.

7. The acoustical shield assembly and thread preguide unit of claim 6, wherein said acoustical shield assembly includes a plurality of side panels and wherein said downwardly extending flange cooperates in the closed position with one of said panels underlying said downwardly extending flange to define an elongated opening for receipt of said preguide unit.

8. The acoustical shield assembly and thread preguide unit of claim 7, wherein said mating means includes upper and lower bearing surfaces on each spacer post, said upper bearing surfaces contacting said downwardly extending flange of said hinged top panel and said lower bearing surfaces contacting said underlying side panel.

9. The acoustical shield assembly and thread preguide unit of claim 8, wherein said at least one eyelet is positioned between and in the same plane as said spacer posts on said face plates and the thread passes through the elongated opening between said spacer posts with said spacer posts sealing the ends of the elongated opening for maximum noise attenuation.

10. The acoustical shield assembly and thread preguide unit of claim 9, wherein said mating means includes opposing first and second sealing surfaces, said first sealing surface being provided along the interior of said downwardly extending flange and said underlying side wall adjacent the elongated opening and said second sealing surface being provided along the surface of said second face plate facing said first face plate; said first and second sealing surfaces contacting each other when said preguide unit is properly positioned in relation to said shield assembly so as to seal the assembly for maximum noise attenuation.

11. The acoustical shield assembly and thread preguide unit of claim 10, wherein one of the plurality of panels in said acoustical shield assembly includes a further side panel substantially perpendicular to said underlying side panel and positioned adjacent to said preguide assembly; said further side panel being readily displaceable from the remainder of said acoustical shield assembly, thereby allowing removal of said shield assembly from around the sewing machine and attached preguide unit when said hinged top panel portion is opened so as to allow access to the machine for maintenance purposes without the need to remove thread from the sewing machine.

12. The acoustical shield assembly and thread preguide unit of claim 1, wherein said mounting means includes means for adjusting the position of the preguide unit relative to the sewing machine and acoustical shield assembly so as to provide proper mating of the preguide unit in substantially sealing relation with the shield assembly for maximum noise attenuation.

13. The acoustical shield assembly and thread preguide unit of claim 12, wherein said mounting means includes first and second mounting rods.

14. The acoustical shield assembly and thread preguide unit of claim 13, wherein said adjusting means includes at least one elongated aperature in said second face plate, at least one of said mounting rods being slidably received in said elongated aperture.

15. The acoustical shield assembly and thread preguide unit of claim 13, wherein said adjusting means includes slot means in said mounting rods allowing positioning of said face plates of said preguide unit toward and away from the sewing machine for proper mating with said shield assembly.

* * * * *